US008534032B2

(12) United States Patent
Hirano

(10) Patent No.: US 8,534,032 B2
(45) Date of Patent: Sep. 17, 2013

(54) METHOD FOR PLACING INERT GAS IN GAS-FILLING PACKAGING MACHINE

(75) Inventor: Yoshifumi Hirano, Inuyama (JP)

(73) Assignee: General Packer Co., Ltd., Aichi (JP)

( * ) Notice: Subject to any disclaimer, the term of this patent is extended or adjusted under 35 U.S.C. 154(b) by 0 days.

(21) Appl. No.: 11/991,655

(22) PCT Filed: Nov. 29, 2005

(86) PCT No.: PCT/JP2005/021846

§ 371 (c)(1),
(2), (4) Date: Apr. 21, 2008

(87) PCT Pub. No.: WO2007/029352

PCT Pub. Date: Mar. 15, 2007

(65) Prior Publication Data

US 2009/0223172 A1 Sep. 10, 2009

(30) Foreign Application Priority Data

Sep. 7, 2005 (JP) ..... 2005-259020

(51) Int. Cl.
*B65B 31/06* (2006.01)
*B65B 31/00* (2006.01)

(52) U.S. Cl.
USPC ..... 53/434

(58) Field of Classification Search
USPC ..... 53/432, 434, 440, 477, 510, 512, 53/127, 370.7, 373.7
See application file for complete search history.

(56) References Cited

U.S. PATENT DOCUMENTS

| | | | | |
|---|---|---|---|---|
| 5,354,569 | A * | 10/1994 | Brown et al. | 426/411 |
| 6,543,206 | B2 * | 4/2003 | Seward et al. | 53/434 |
| 2001/0005974 | A1 * | 7/2001 | Kondo et al. | 53/508 |

FOREIGN PATENT DOCUMENTS

| | | |
|---|---|---|
| JP | 55-071223 | 5/1980 |
| JP | 3-5532 | 2/1991 |
| JP | 03-148419 | 6/1991 |
| JP | 07-187129 | 7/1995 |
| JP | 10-114307 | 5/1998 |
| JP | 2884064 | 4/1999 |
| JP | 2004-067224 | 3/2004 |

* cited by examiner

*Primary Examiner* — Alexandra Elve
*Assistant Examiner* — John Paradiso
(74) *Attorney, Agent, or Firm* — DLA Piper LLP (US)

(57) ABSTRACT

A filling method including a preceding filling process in which the drop opening of the filling funnel and the forward end of the gas-filling nozzle brought close to the normal line are inserted from the opened bag opening into a package bag, and at the same time, the forward end is separated from the normal line and moved toward a corner of the package bag. The method further includes a following filling process in which inert gas jetted from the gas filling nozzle and air in the package bag are replaced with each other, and a postprocess on the downstream side in which the replacement action between the inert gas and the air is promoted with the bag opening substantially closed by a shutter unit.

2 Claims, 9 Drawing Sheets

METHOD FOR PLACING INERT GAS IN GAS-FILLING PACKAGING MACHINE

TECHNICAL FIELD

The present invention relates to a method for filling a gas-filling packaging machine with an inert gas, in which machine gas replacement is carried out by supplying the inert gas from a nozzle into a packaging bag previously filled with articles so that air in the bag is expelled out and a top of a packaging bag is subsequently sealed.

BACKGROUND ART

A method for filling a conventional gas-filling packaging machine with an inert gas is disclosed in JP-A-2004-67224 by the present applicant. The gas-filling packaging machine is constructed so that a single intermittently rotating table is used for filling a packaging bag with articles, filling an inert gas such as nitrogen gas and heat-sealing a top of the bag after the bag has been filled with the articles and inert gas. A nozzle for filling with the inert gas is constructed so as to be fixed to an outer surface of a filling funnel provided on a packaging bag the top of which is open. The filling funnel has a discharge hole which rises and sets relative to the packaging bag.

The nozzle for filling the packaging bag with the inert gas employs such a structure as to be fixed to the outer surface of the filling funnel as described in the foregoing gazette or such a structure as to be fixed to a central inside of the filling tunnel. However, a distal end of the nozzle is inserted into a corner of the packaging bag in the former fixing structure. Accordingly, when the packaging bag is a flat bag or a packaging gusset bag e as shown in FIG. 8, the distal end of the nozzle tends to be easily detached from the top of the bag. Furthermore, FIG. 9 shows a chuck bag a with side gusset. The chuck bag a has both sides with folds c respectively. There is a rare defect that the distal end of the nozzle n sticks into inwardly extending parts of the folds c.

In the latter nozzle fixing structure, the nozzle fixed to the central inside of the filling funnel constitutes a barrier to the article passing, resulting in an increase in the filling time. As a result, the filling funnel is clogged by the article in some cases.

Furthermore, in the inert gas filling method described in the above gazette, gas replacement is not carried out while the top of the bag is closed. Accordingly, gas replacement is sometimes unfavorable depending upon a type or size of a packaging bag or a type of the article.

Patent Document: JP-A-2004-67224

DISCLOSURE OF THE INVENTION

An object of the present invention is to provide an inert gas filling method in a gas-filling packaging machine, which method can overcome defects in the case where the gas-filling nozzle a is inserted into a packaging bag and a gas replacement rate can be improved.

Means for Overcoming the Problem

To achieve the object, the present invention described in claim 1 is a method for placing an inert gas in a gas-filling packaging machine in which a rotating body is provided with a number of pairs of radial grips and filling funnels disposed so as to correspond to the paired grips and so as to be vertically movable and is intermittently stopped and moved for every one of a plurality of steps by an intermittent drive unit in a filling sep so that a packaging bag suspended by each grip pair is filled with a predetermined amount of article to fill the packaging bag and an inert gas is blown out of a gas-filling nozzle provided on each filling funnel so that air is replaced by the inert gas in the packaging bag and subsequently, a top of the bag is sealed, wherein the gas-filling nozzle has a distal end which is movable so as to get close to and to depart from an imaginary perpendicular line passing a center of a drop mouth of each filling funnel by a nozzle attitude control unit; prior to a filling step, the drop mouth of the filling funnel and the distal end of the gas-filling nozzle close to the perpendicular line are inserted from the open top of the packaging bag into the bag and simultaneously, the distal end of gas-filling nozzle is departed from the perpendicular line thereby to be moved toward a corner of the packaging bag; replacement is carried out between the inert gas blown out of the gas-filling nozzle and air in the packaging bag at the filling step and/or a step subsequent to the filling step; and at another step subsequent to the filling step, the replacement between the inert gas and the air in the bag is accelerated while the top of the bag is substantially closed by a shutter unit and thereafter, the bag top is released from a closed state and thereafter, the gas-filling nozzle is pulled out of the packaging bag.

To achieve the same object, the invention described in claim 2 is characterized in that in the invention described in claim 1, the nozzle attitude control unit includes a holder which is provided on a side of the filling funnel so as to be rockable and to which an upper end of the gas-filling nozzle is fixed and a roller which is provided on the holder so as to be rotatable; when the filling funnel is intermittently stopped at the step prior to the filling step, the roller is caused to abut against a cam plate disposed so as to be vertically elongated at the step, whereby the distal end of the gas-filling nozzle is close to the perpendicular line; and the filling funnel is moved downward so that the distal end of the gas-filling nozzle is inserted into the packaging bag and so that the distal end is departed from the perpendicular line thereby to be moved to the corner side of the packaging bag.

To achieve the same object, the invention described in claim 3 is characterized in that in the invention described in claim 1 or 2, the packaging bag is a flat bag, a packaging bag having folds on both sides respectively except for the top thereof or a gusset bag.

Effect of the Invention

According to the invention described in claim 1, the distal end of the gas-filling nozzle is inserted into the packaging bag while being close near to the center of the drop mouth of the filling funnel by the nozzle attitude control unit. Accordingly, an erroneous insertion and defect of the nozzle can be resolved. More specifically, the nozzle can be prevented from disengaging from the open top of the bag when inserted into the bag. Furthermore, the nozzle can be prevented from sticking into the folds of the packaging bag of the gusset type. Additionally, since the final gas replacement is carried out while the bag top is closed by the shutter unit, the gas replacement rate is improved.

According to the invention described in claim 2, the structure of the nozzle attitude control can be simplified and a gas filling work can carried out smoothly and stably.

According to the invention described in claim 3, the method can be applied to various types of packaging bags such as a flat bag, a packaging bag having folds on both sides respectively except for the top thereof (side gusset chuck bag) or a gusset bag, whereupon a gas filling work can carried out smoothly and stably.

BEST MODE FOR CARRYING OUT THE INVENTION

A best mode of the present invention will be described with reference to the accompanying drawings. FIG. 1 is a side view of the gas-filling packaging machine to which the method for filling a gas-filling packaging machine with an inert gas is applied. FIG. 2 is a plan view of the machine. FIG. 3 is a side view of a rotating body, a filling funnel and peripheral structure. FIG. 4 is a view explaining a nozzle attitude control unit. FIG. 5 is a development of cam rail showing the relative positional relationship among a filling funnel, gas-filling nozzle and packaging bag over a whole process. FIG. 6 is a side view of a shutter unit showing execution of gas replacement with the bag top being closed. FIG. 7 is a plan view of the shutter unit shown in FIG. 6.

FIGS. 1 and 2 show a gas-filling packaging machine P to which the method of the invention for filling a gas-filling packaging machine with an inert gas is applied. The rotary gas-filling packaging machine P comprises a weighing device (not shown) supplying a predetermined amount of article to a filling funnel and an inert gas supplier as shown in FIG. 2. The machine carries out ten steps including a bag feeding step A, step B of opening a chuck of packaging bag, step C of swelling a lower part of the bag when the bag is a gusset bag, step D of opening the top of the bag, step E of filling an article to be packed, vibrating steps F and G, idling step H, step I of closing the chuck and heat-sealing the bag top and step J of cooling a sealed part and releasing products.

The embodiment will be described with a side gusset chuck bag (hereinafter referred to as "packaging bag") having folds on both sides respectively except for the top thereof as shown in FIG. 9.

The method of the invention may be applied to a flat bag, a packaging bag having folds on both sides respectively except for the top thereof or a gusset bag.

A stand 3 is mounted on a mounting 1 of the packaging machine P for rotatably supporting a vertically elongated intermittent rotational shaft 2 rotated by a drive unit (not shown). A disc-shaped rotating body 4 is mounted on the intermittent rotational shaft 2. On the rotating body 4 are mounted ten pairs of grips 9 (the same number as the steps) for gripping and releasing a packaging bag a which is provided with a chuck d and which is open only at a top thereof. The grips 9 are provided so as to protrude radially at equiangular intervals. The intermittent rotational shaft 2 has an upper end on which a boss 7 of a drum 6 is supported by a plurality of bearings 5 so that the drum 6 is rotatable. The drum 6 is fixed just over the rotating body 4 so as to be concentric with the intermittent rotational shaft 2.

A pair of guide bars 15 stands in parallel on the outer peripheral edge 4*a* of the aforesaid rotating body 4 so as to correspond to a central position of each paired grips 9, as shown in FIG. 3. The guide bars 15 have respective upper ends which are mounted on a ring plate 16. Reference symbol 17 designates a slide plate 17 attached to the paired guide bars 15 so as to be vertically movable. A bracket 19 is provided in front of the slide plate 17 for mounting a filling funnel 21. A cam roller 20 rotatably protrudes on the central rear of the slide plate 17.

The same number of filling funnels 21 as the number of steps is provided. The filling funnels 21 are provided with gas filling nozzles 23 respectively. As shown in FIG. 41 each gas filling nozzles 23 is provided so that a distal end 23*b* thereof comes close to and departs from an imaginary perpendicular line v passing through the center of a drop opening 21*a* of the filling funnel 21.

The foregoing nozzle attitude control unit 25 will now be described in detail. The nozzle attitude control unit 25 includes a holder 28 is supported by a shaft 27 on the block 26 mounted on a horizontal portion 19*a* of the bracket 19 so that the holder 28 is rockable in a direction horizontal to the aforesaid perpendicular line v. The holder 28 has an L-shape as viewed from the side and includes a horizontal piece 28*a* to which the upper end 23*a* of the gas filling nozzle 23 is fixed and a vertical piece 28*b* on which a roller 30 is rotatably mounted. The gas filling nozzle 23 has a distal end 23*b* which protrudes a predetermined dimension below the drop opening 21*a* of the filling funnel 21 and is provided so as to normally retain the perpendicular attitude. Reference symbol 31 designates a rubber piece interposed between the block 26 and the horizontal piece 28*a* of the holder 28 and having a spring function.

When the filling funnel 21 is intermittently stopped at an opening step D prior to a filling step E, the roller 30 is abutted against the cam plate 29 disposed so as to be vertically elongated at the step, so that the distal end 23*b* of the filling nozzle 23 is moved to be come close to the aforesaid perpendicular line v. As the result of downward movement of the filling funnel 21, the distal end 23*b* of the gas filling nozzle 23 is inserted into the packaging bag a. Thereafter, the roller 30 is detached from the cam plate 32, whereby the distal end 23*b* is departed from the perpendicular line v thereby to be moved to a corner side of the packaging bag a.

When the distal end 23*b* of the gas filling nozzle 23 is moved to be close to the perpendicular line, the middle portion of the nozzle 23 enters a notch 21*b* formed in the filling funnel 21.

The drum 7 has an outer surface in which cam surfaces of lower cam rails 35*a* to 35*c* and cam surfaces of upper cam rails 36*a* to 36*c* are opposed to each other so that cam grooves 37 having predetermined intervals, as shown in FIG. 5. The cam roller 20 of the slide plate 17 is inserted into the cam groove 37, and the cam roller 20 is born by the cam rails 35*a* to 35*c*. The movement of the rotating body 4 by the intermittent rotation causes the cam roller 20 of each slide plate 17 to roll on the lower cam rails 35*a* to 35*c*, whereby the filling funnel 21 mounted on each slide plate 17 and the gas filling nozzle 23 are vertically moved together.

A slider mechanism is provided in the drum 7 in the packaging bag opening step D. A slider 40 having a square guide bar 39 standing thereon is loosely fitted in the slider mechanism so as to be movable. The slider 40 is movable upward and downward by an elevation unit comprising a mechanism (not shown) comprising a cam and a lever or the like. A supporting piece 41 is provided on a front surface of the slider 40 to receive the cam roller 20 of the slide plate 17. Furthermore, a similar slider mechanism is provided in the idling step H, and the similar components in the idling step H are labeled by the same reference numerals as in the opening step D. The description of these components will be eliminated.

The mechanism for moving the number of filling funnels upward and downward by the cam rail on the circumference of the fixed drum is constructed on the basis of the disclosure of Japanese Patent No. 2884064 owned by the applicant of this application. The slider mechanism for moving the filling funnels upward and downward in a specific step is also constructed on the basis of the disclosure of Japanese Patent No. 2884064.

Reference numeral 45 designates a rotary valve disposed on the drum 6. The rotary valve 45 comprises a central valve shaft 45*a* fixed at the drum 6 side and a ring-shaped valve disc 46 rotatably mounted on the valve shaft 45*a*. The valve disc 46 is provided with ten gas supply holes (not shown) the number of which is the same as the number of steps. The gas supply holes communicate with a gas passageway of the valve shaft. Furthermore, the valve disc 46 is connected to the ring plate 16 by a stay 47 and is rotatable together with the rotating body 4.

The gas supply holes and the gas filling nozzle 23 are connected to each other by a flexible tube 51. Furthermore, an inert gas such as nitrogen gas or carbon-dioxide gas adjusted at a predetermined pressure (0.1 to 0.3 MPa) is supplied from an inert gas supply unit 55 through a hose 56 to the valve shaft 45*a* of the rotary valve 45. The valve shaft 45*a* has an upper end supported by a bearing member 48. The bearing member 48 is fixed to a connecting plate 50 which connects a pair of posts 49 standing on the mounting 1 to each other.

The inert gas supply system is composed on the basis of the disclosure of Japanese Patent No. 2619795 owned by the applicant of this application.

A belt-conveyor packaging bag supplying apparatus 60 is disposed at a bag supplying step A. The packaging bag supplying apparatus 60 has a known structure, that is, a number of packaging bags a stacked on a belt-conveyor 61 one upon another with the tops b down. The packaging bags a are separated one by one by a feeder unit 62 to be hung with the tops b up and supplied to the grips 9.

Japanese Utility Model Publication No. JP-Y-H03-5532 discloses an example of the foregoing type of packaging bag supplying apparatus which is related to the present application.

A shutter unit 65 is disposed at the idling step H for expediting replacement of air in the packaging bag a by an inert gas while the tops b of the bags a are substantially closed. The shutter unit 65 comprises one shutter member 66 disposed at the front side of the packaging bag and the other shutter member 67 disposed at the rear side of the packaging bag as shown in FIG. 6. The shutter members 66 and 67 are opened and closed by actuation of a lever mechanism (not shown). The shutter members 66 and 67 are formed with respective escape grooves 66*a* and 67*a* preventing the gas filling nozzle inserted into the bag a from being broken.

The structure of an opening apparatus, a sealing apparatus and the like in the gas filling packaging machine P is based on a known structure and accordingly, a detailed description of the structure will be eliminated. Only part of the structure related with the present invention will be described.

Next, the inert gas filling method in the gas filling packaging machine will be described in relation with an operation of the gas filling packaging machine P.

(1) The packaging bags a are supplied to the paired grips 9 by the packaging bag supplying apparatus 60 with the bag tops b down at a bag supplying step A.

(2) The chucks d of the bags a are opened and a use-by date and the like are printed on the bags by a printing apparatus 65 at a chuck opening step B.

(3) The front and rear of the bags a are adsorbed by a pair of adhesive discs 71 of a blowing apparatus 70 so that a lower part of each bag a is blown up, at a blowing step C. This is carried out in order that articles to be packed may be well settled in the bags.

(4) The front and rear of each packaging bag a are adsorbed by paired adhesive discs 76 so that the top of each bag a is opened by a known opening apparatus 75, and a pair of opening and closing pieces b are inserted into each bag b to retain each bag in an open state, at bag opening step D.

(5) On the other hand, the cam roller 20 is transferred from the lower cam rail 35*b* to the support piece 41 of the slider 40 which is on standby at an upper position. In this case, since the roller 30 of the nozzle attitude control unit abuts against the ca plate 32, the distal end 23*b* of the gas filling nozzle 23 is moved close to the perpendicular line, as shown in FIG. 4. The slider 40 is then lowered so that the distal end 23*b* of the gas filling nozzle 23 is inserted into the bag a and thereafter, the roller 30 is disengaged from the cam plate 32. Accordingly, the distal end 23*b* is departed from the perpendicular line thereby to be moved away to a corner of the bag a. As a result, the drop mouth 21*a* of the filling funnel 21 and the distal end 23*b* of the gas filling nozzle 23 are inserted into the bag a.

The opening and closing piece 56 of the opening apparatus 55 is moved upward after insertion of the filling funnel 21, thereby being returned to the V-shaped closed state.

(6) The cam roller 20 of the slide plate 17 transferred from the support piece 41 of the slider 40 assuming a lower position to the cam rail 35*c* by the intermittent rotation of the rotating body 4, and the bag a is intermittently transferred to the article filling step E.

(7) A predetermined amount of article to be packed is discharged into the filling funnel by the weighing device at the filling step E, thereby filling the bag a.

(8) A distance between the paired grips 9 is increased and the bag top b is stretched straightforward so that external air is prevented from entering the bag a. Simultaneously, the inert gas is spouted from the gas filling nozzle 23. The replacement of air in the bag a by the inert gas continuously supplied and diffused is enhanced while the bag a is being vibrated by a vibratory device (not shown).

(9) The cam roller 20 of the slide plate 17 is transferred from the lower cam rail 35*c* to the support piece 41 of the slider 40 which is on standby at the lower position at an idling step H. After the replacement of air in the bag a by the inert gas is enhanced while the bag top b is substantially closed by the shutter unit 65 as shown in FIG. 6, the bag a is released from the closed state. Subsequently, the gas filling nozzle 23 is caused to get out of the bag a by the rise of the slider 40.

(10) The chuck d of the bag a is closed and the bag top is heat-sealed by a sealer 80 at a chuck closing and top heat-sealing step I.

(11) Subsequently, a portion heat-sealed at the previous step is cooled by a seal cooler 85 and thereafter, the bag a is caused to fall onto a chute 90 by a releasing operation of the paired grips 9 to be discharged out of the machine.

The inert gas is supplied between the vibrating step and the idling step H for the gas replacement in the embodiment. However, the inert gas may be supplied between filling step E and the idling step H for gas replacement.

As described above, in the inert gas placing method in the gas filling packaging machine of the present invention, an erroneous insertion and defect of the nozzle can be resolved. More specifically, the nozzle can be prevented from disengaging from the open top of the bag when inserted into the bag. Furthermore, the nozzle can be prevented from sticking into the folds of the packaging bag of the gusset type. Additionally, since the final gas replacement is carried out while the bag top is closed by the shutter unit, the gas filling work can be carried out smoothly and stably.

EXPLANATION OF REFERENCE NUMERALS

Figure 1:
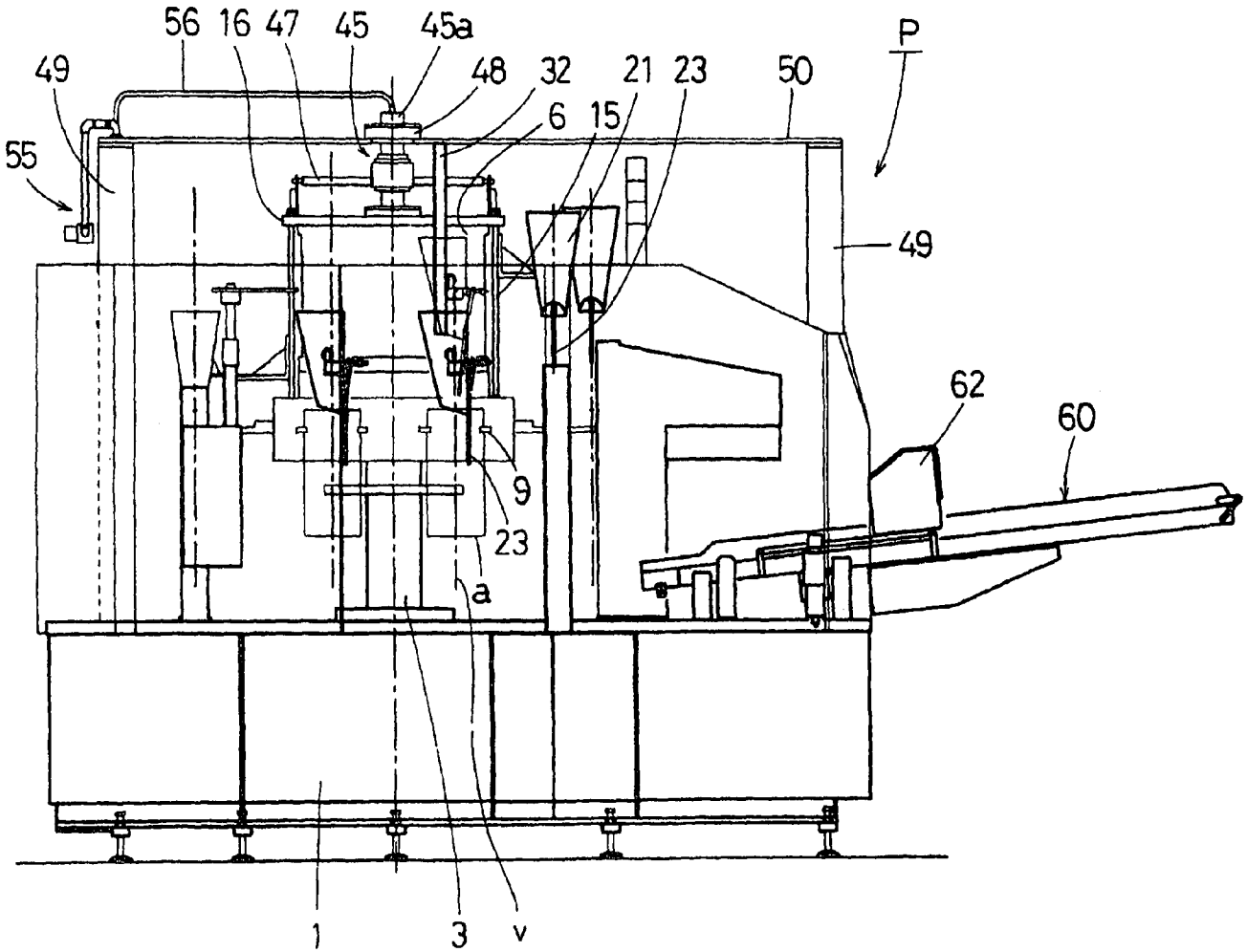
FIG. 1 is a side elevation of a gas filling packaging machine to which the inert gas filling method of the present invention is applied.
Figure 2:
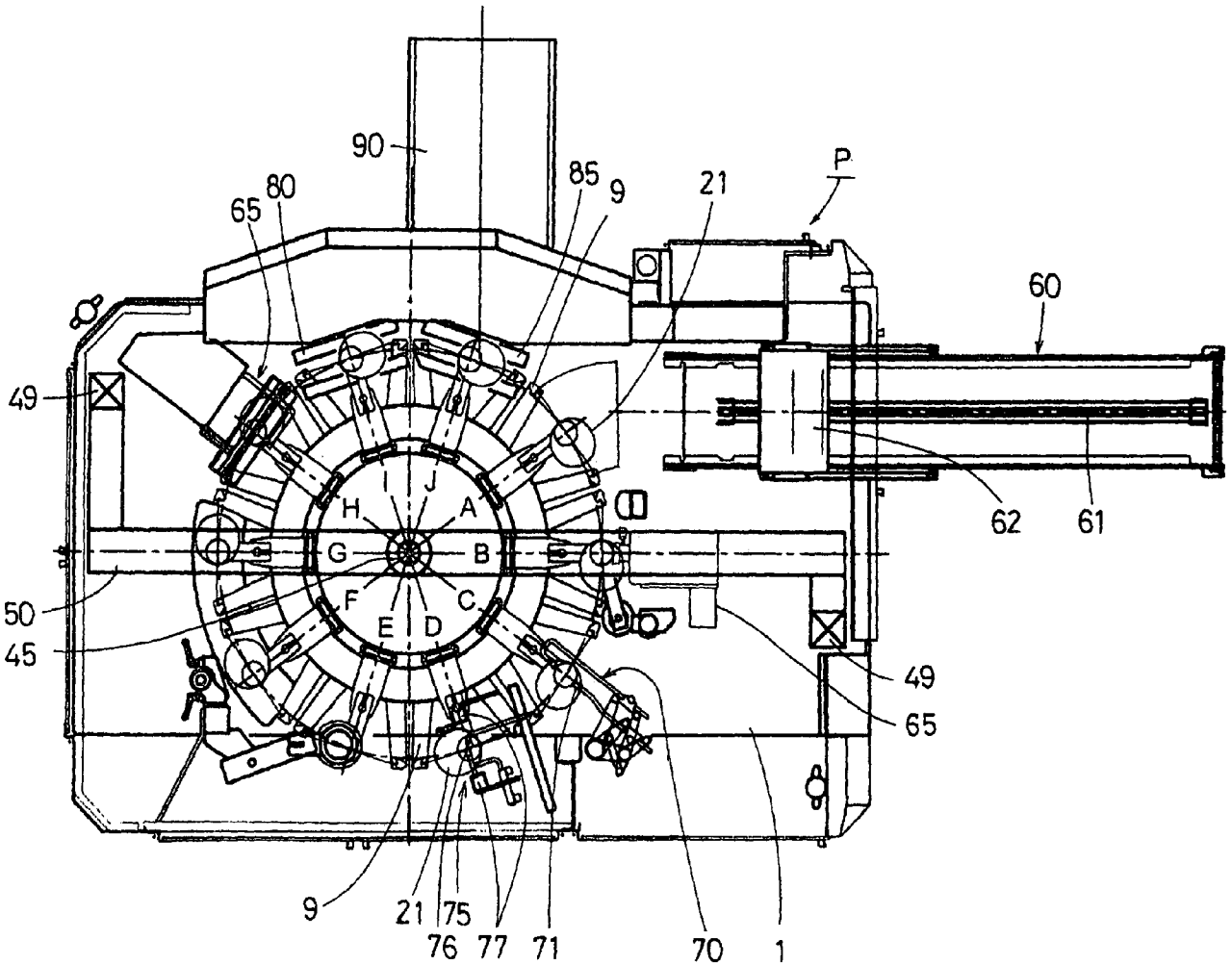
FIG. 2 is a plan view of the gas filling packaging machine to which the inert gas filling method of the present invention is applied.
Figure 3:
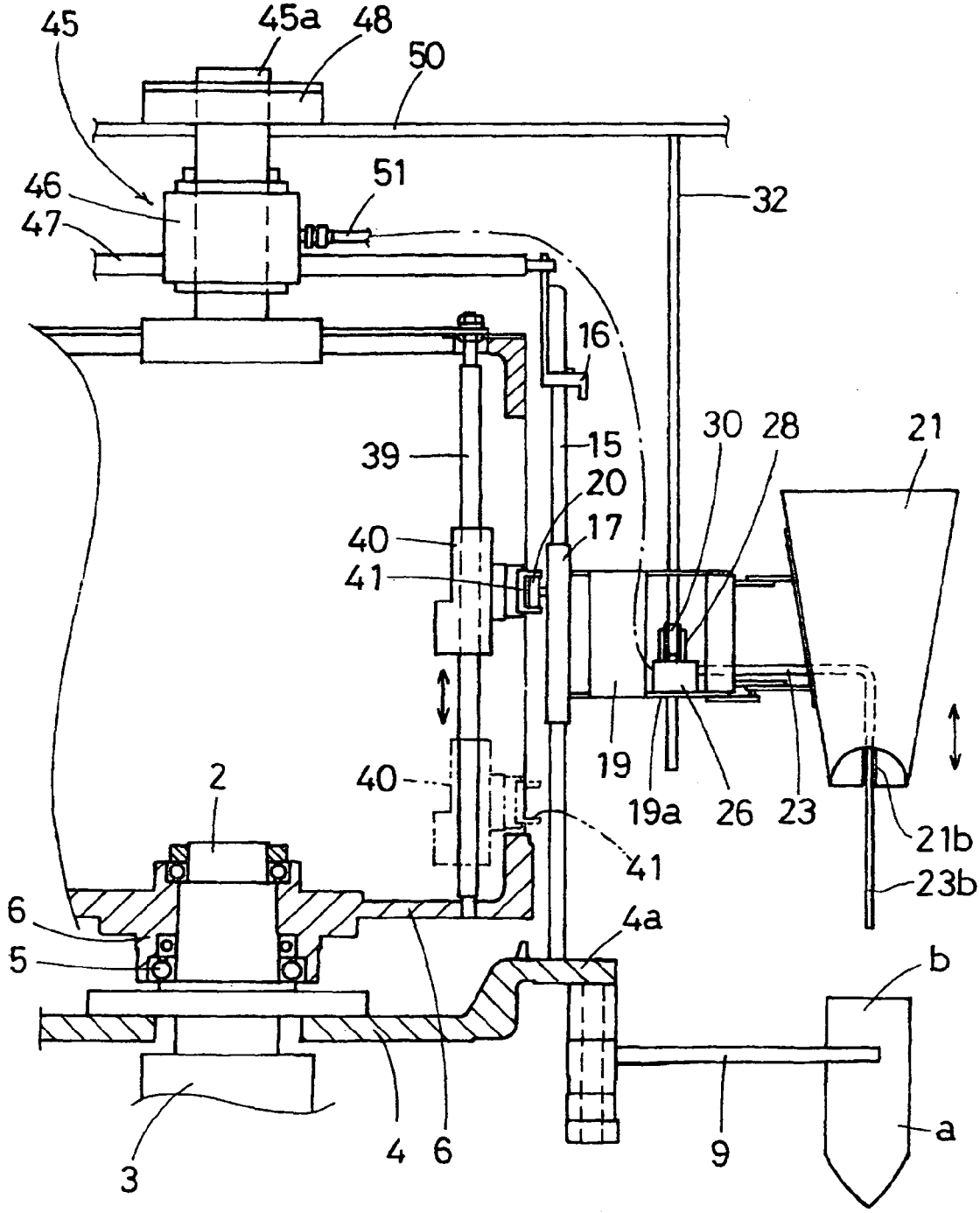
FIG. 3 is a side elevation of a rotating body, filling funnel and the peripheral structure.
Figure 4:
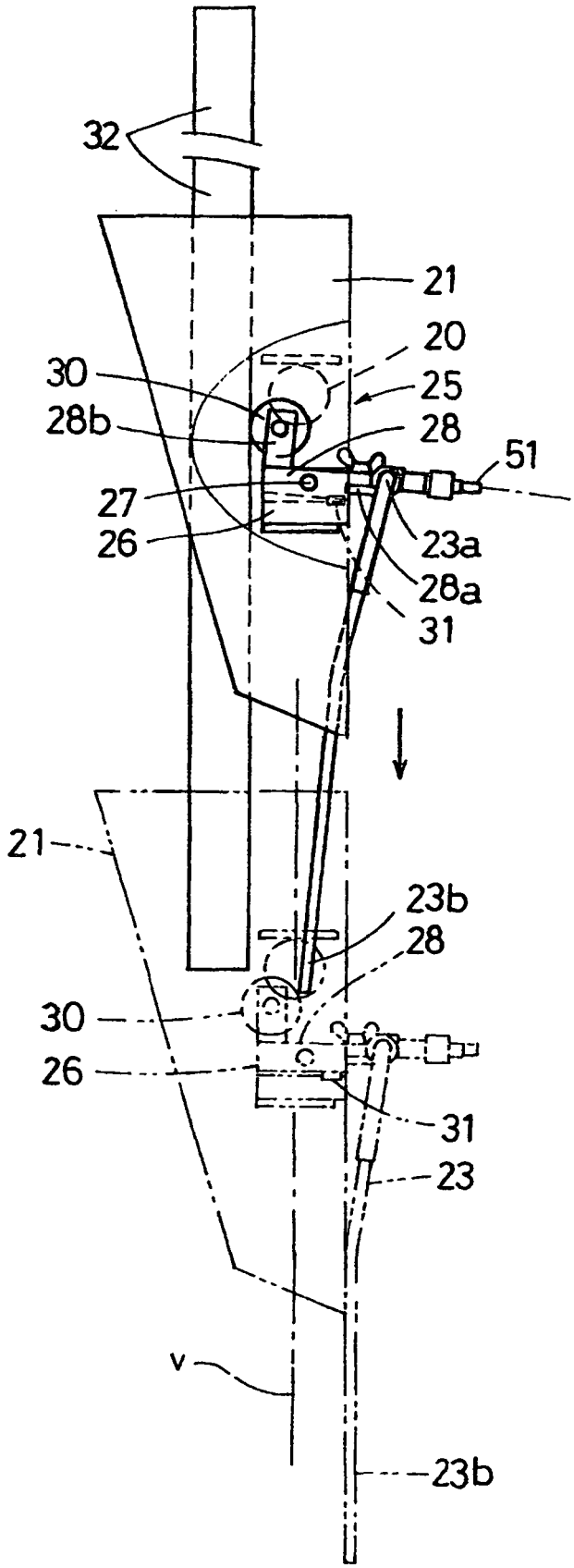
FIG. 4 is a view explaining a nozzle attitude control unit.
Figure 5:
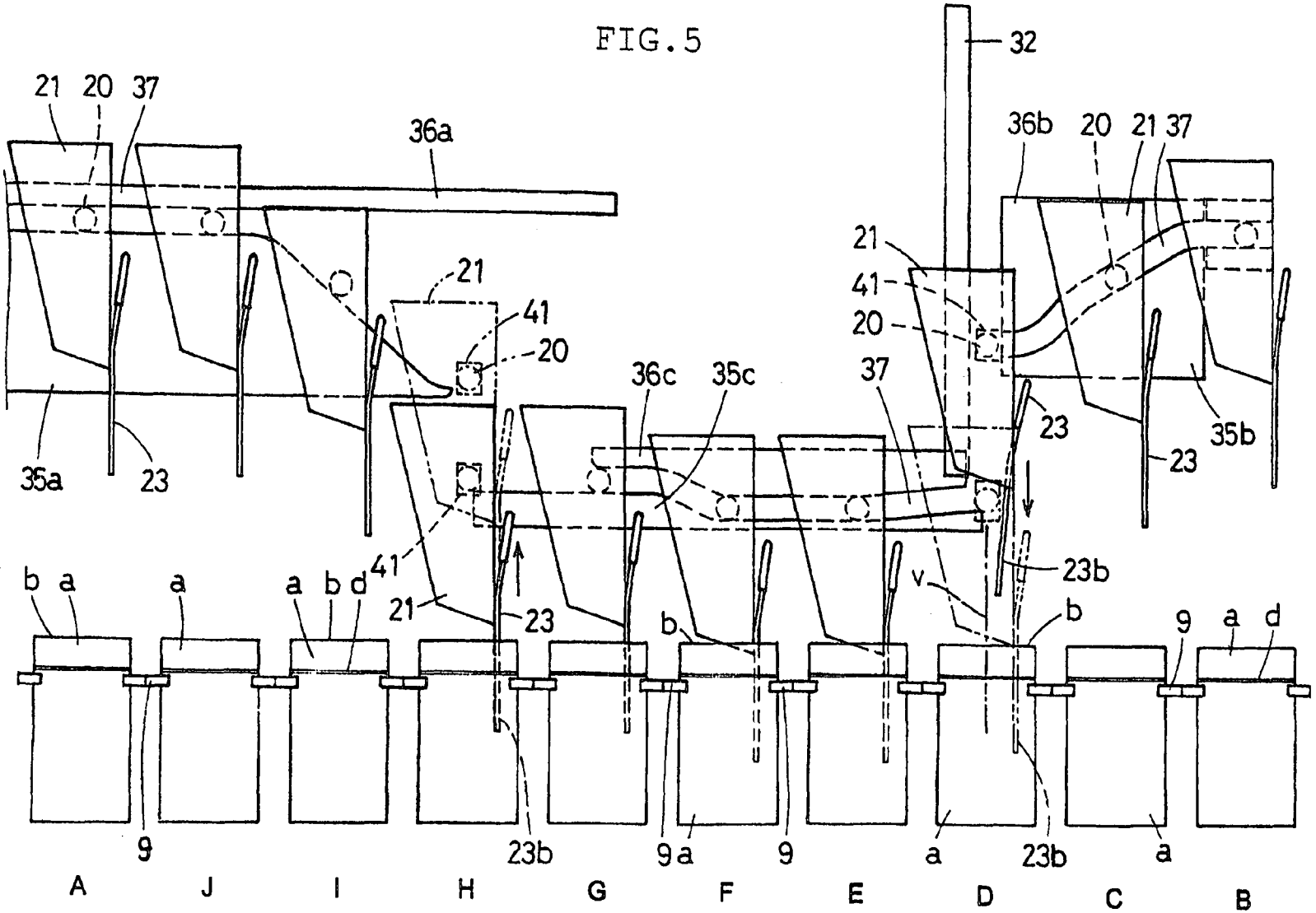
FIG. 5 is a development of a cam rail showing the relative positional relationship among the filling funnel, gas filling nozzle and packaging bag in overall steps.
Figure 6:
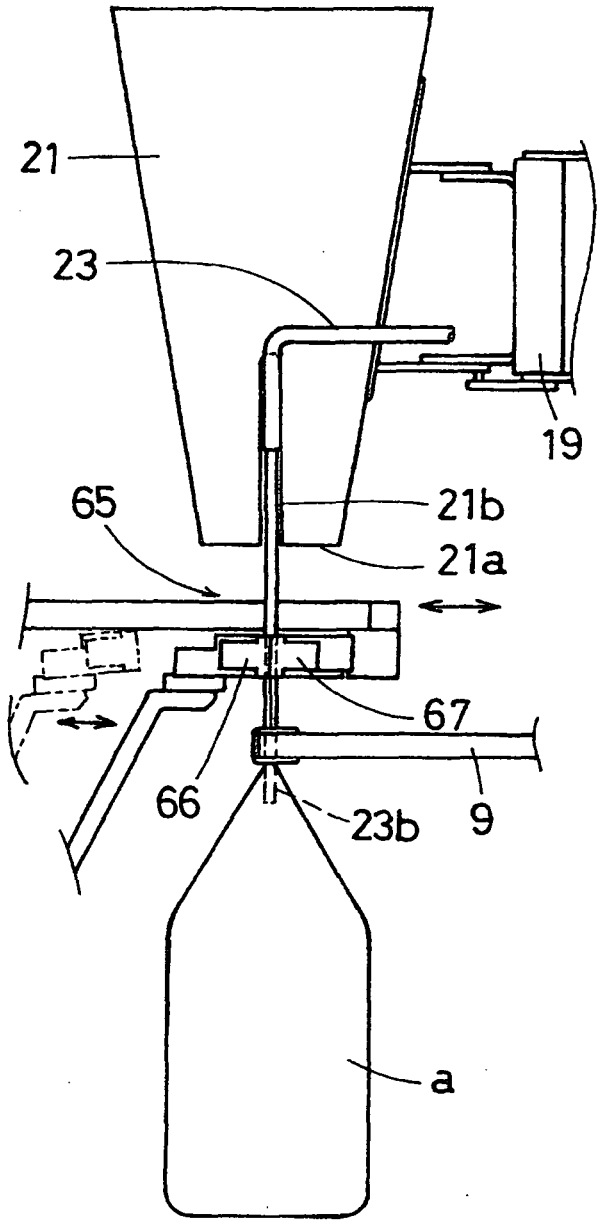
FIG. 6 is a side elevation of a part of shutter unit, showing the condition where the gas replacement is to be carried out with the bag top being closed.
Figure 7:
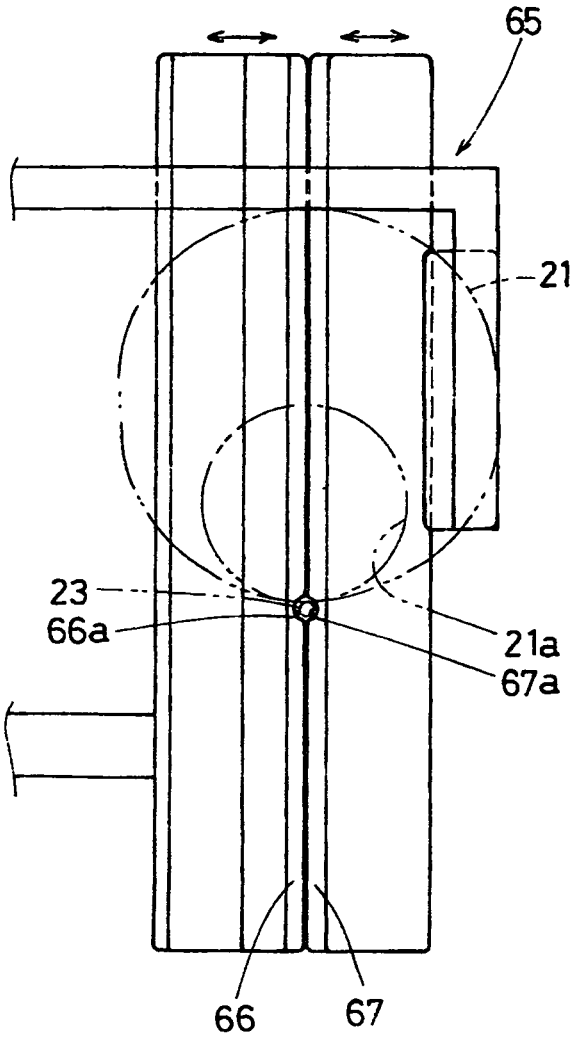
FIG. 7 is a plan view of the shutter unit.
Figure 8:
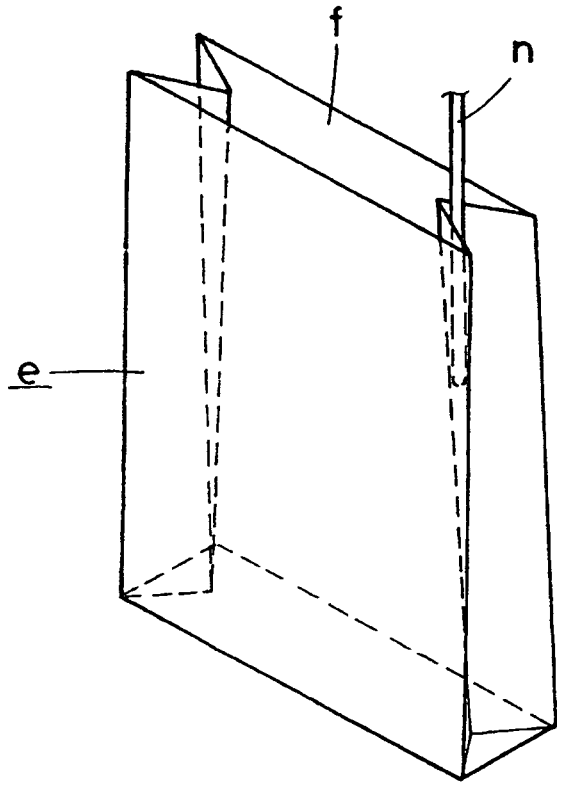
FIG. 8 is a view explaining an erroneous insertion of a nozzle by a conventional inert gas filling method.
Figure 9:
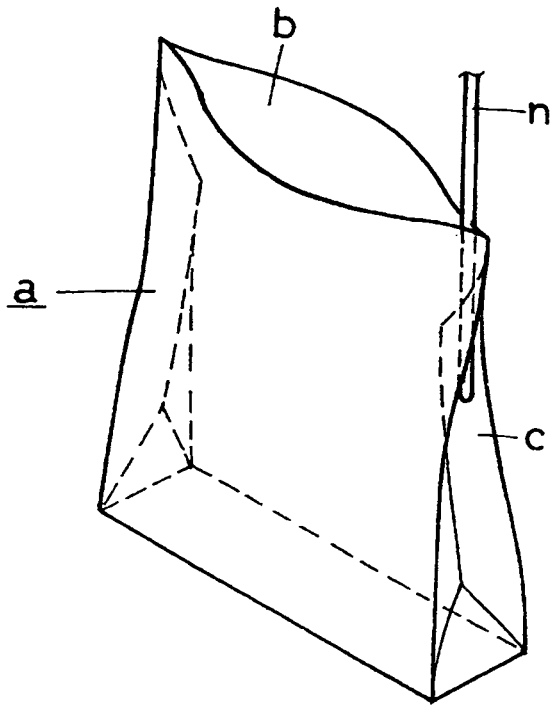
FIG. 9 is a view explaining an erroneous insertion of a nozzle by a conventional inert gas filling method.

P . . . gas filling packaging machine
a . . . packaging bag
b . . . bag top c . . . fold
v . . . imaginary perpendicular line
4 . . . rotating body
9 . . . paired grips
21 . . . filling funnel
21*a* . . . drop mouth
23 . . . gas filling nozzle
23*b* . . . distal end
25 . . . nozzle attitude control unit
30 . . . roller
32 . . . cam plate
55 . . . inert gas supplying apparatus
65 . . . shutter unit

The invention claimed is:

1. A method for providing an inert gas into a packaging bag in a packaging machine in which a rotating body is provided with a number of pairs of radial grips and filling funnels are disposed so as to correspond to paired grips and so as to be vertically movable and intermittently stopped and moved for every one of a plurality of steps including a packaging bag feeding step, a step of opening a top of the packaging bag, a step of filling articles to be packed into the packaging bag, a step of heat-sealing the packaging bag top and a step of cooling said sealed part of said packaging bag and releasing products by an intermittent drive unit during said filling step so that a packaging bag suspended by each grip pair is filled with a predetermined amount of articles to fill the packaging bag and further comprising the steps of:

providing a gas filling nozzle in each filling funnel;

blowing an inert gas out of said gas-filling nozzle provided on each filling funnel so that air is replaced by the inert gas in the packaging bag while the top of the packaging bag is open;

moving a tip of the gas-filling nozzle toward an imaginary perpendicular line passing through a center of and perpendicular to a drop mouth of each filling funnel by a nozzle attitude control unit such that the tip of the gas-filling nozzle is close to the imaginary perpendicular line;

inserting, prior to a filling step, the drop mouth of the filling funnel and the tip of the gas-filling nozzle close to the perpendicular line into the open top of the packaging bag into the packaging bag and simultaneously, moving the tip of gas-filling nozzle away from the perpendicular line toward a corner of the packaging bag;

replacing the air in the packaging bag at the filling step and/or a step subsequent to the filling step with the inert as blown out of the gas-filling nozzle which is provided in said each filling funnel;

closing the top of the packaging bag after the filling step with a shutter unit;

at the step subsequent to the filling step, accelerating the replacement with the inert gas for the air in the packaging bag while the top of the packaging bag is substantially closed by said shutter unit;

releasing the packaging bag top from a closed state with said shutter unit and thereafter, pulling the gas-filling nozzle out of the packaging bag; and sealing the top of the packaging bag.

2. The method according to claim 1, wherein the nozzle attitude control unit includes a holder which is rockably provided on a side of the filling funnel and to which an upper end of the gas-filling nozzle is fixed and a roller which is provided on the holder so as to be rotatable; when the filling funnel is intermittently stopped at the step prior to the filling step, the roller is caused to abut against a cam plate disposed so as to be vertically elongated at the step, whereby the tip of the gas-filling nozzle is close to the perpendicular line; and the filling funnel is moved downward so that the tip of the gas-filling nozzle is inserted into the packaging bag and so that the tip is departed from the perpendicular line thereby to be moved to the corner side of the packaging bag.

* * * * *